United States Patent [19]

Talwani

[11] 4,170,843

[45] Oct. 16, 1979

[54] ROTATABLE HANGING PLANTER MOUNT

[76] Inventor: Muhammad Y. Talwani, Saddle Shop Rd., Box 91, Ringoes, N.J. 08551

[21] Appl. No.: 895,015

[22] Filed: Apr. 10, 1978

[51] Int. Cl.[2] ..... A01G 9/02

[52] U.S. Cl. ..... 47/39; 47/67; 47/DIG. 6; 211/1.5; 248/317

[58] Field of Search ..... 47/39, 45, 46, 47, 65, 47/DIG. 6, 67; 211/1.5, 106, 113, 131; 248/175, 317, 318

[56] References Cited

U.S. PATENT DOCUMENTS

| | | | |
|---|---|---|---|
| 288,853 | 11/1883 | Poage | 248/317 X |
| 1,210,932 | 1/1917 | Halliday | 248/317 X |
| 1,937,911 | 12/1933 | Pajeau | 248/317 X |
| 2,010,572 | 8/1935 | Waterman | 211/113 X |
| 2,071,290 | 2/1937 | Scriba | 211/131 X |
| 2,325,478 | 7/1943 | Collins | 211/113 |
| 3,615,153 | 10/1971 | Cagle | 211/113 |
| 3,950,637 | 4/1976 | Rodin | 47/67 X |
| 3,995,744 | 12/1976 | Metcalf | 211/131 |
| 3,997,059 | 12/1976 | Hanneman | 211/1.5 |

FOREIGN PATENT DOCUMENTS

| | | | |
|---|---|---|---|
| 241194 | 11/1964 | Austria | 47/39 |
| 626650 | 7/1934 | Fed. Rep. of Germany | 47/45 |

OTHER PUBLICATIONS

Cathey, H. M., et al (5-1971) *Indoor Gardens with Controlled Lighting* Home and Garden Bulletin No. 187, U.S.D.A. pp. 4, 5, 8 and 9.

*Primary Examiner*—Paul T. Sewell
*Assistant Examiner*—James R. Feyrer
*Attorney, Agent, or Firm*—Sanford J. Asman

[57] ABSTRACT

The plant-mobile is a rotating plant hanger which includes a rotatable frame adapted to support a number of hanging plants. Embodiments of the plant-mobile are adapted to be moutned either from a wall or a ceiling, and the plant-mobile includes an associated ceiling or wall mounting means. The rotatable frame includes round balls or hooks from which potted plants may be hung. In addition, the rotatable frame includes radial members which may be used to support the shoots of climbing plants or vines.

10 Claims, 5 Drawing Figures

ROTATABLE HANGING PLANTER MOUNT

BACKGROUND OF THE INVENTION

The present invention relates to plant hangers of the type used to hang decorative plants.

Heretofore, plants have been hung singly, or in groups, for decorative purposes. However, green plants of the type used for decoration in homes and offices generally require a certain minimum amount of light for proper growth, so when they are hung in a fixed location they must be moved from time to time for proper growth.

When groups of plants are hung together, the individual plants tend to block the light received by one another. Therefore, it has previously been necessary to periodically move and rehang plants hung in groups.

In order to avoid the problems associated with providing a number of plants with uniform light as is required for proper growth, while at the same time providing a decorative mobile and hanger for a group of plants, including both climbing and non-climbing plants, the plant-mobile described herein has been invented.

DETAILED DESCRIPTION OF THE INVENTION

Figure 1:
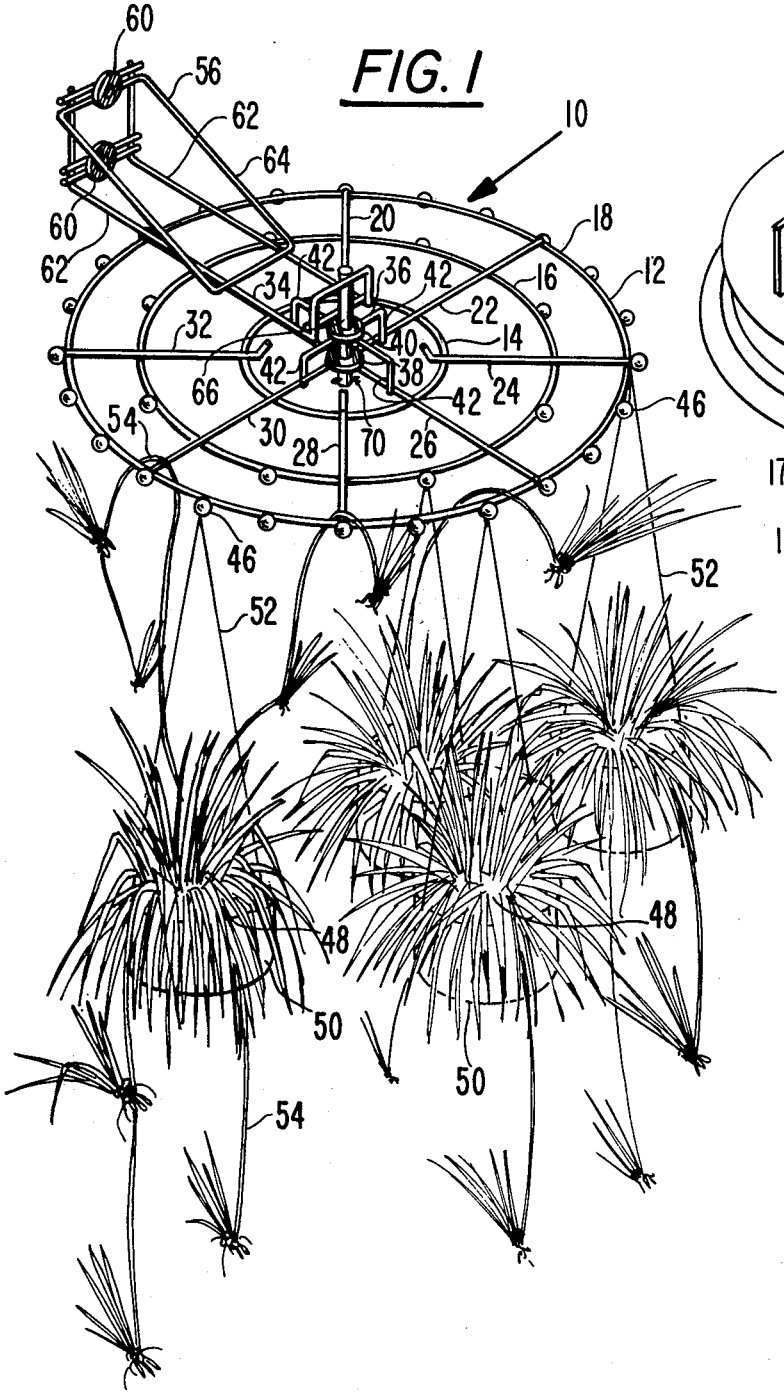
FIG. 1 is a perspective view of one embodiment of the plant-mobile which is adapted to be hung from a wall.
Figure 2:
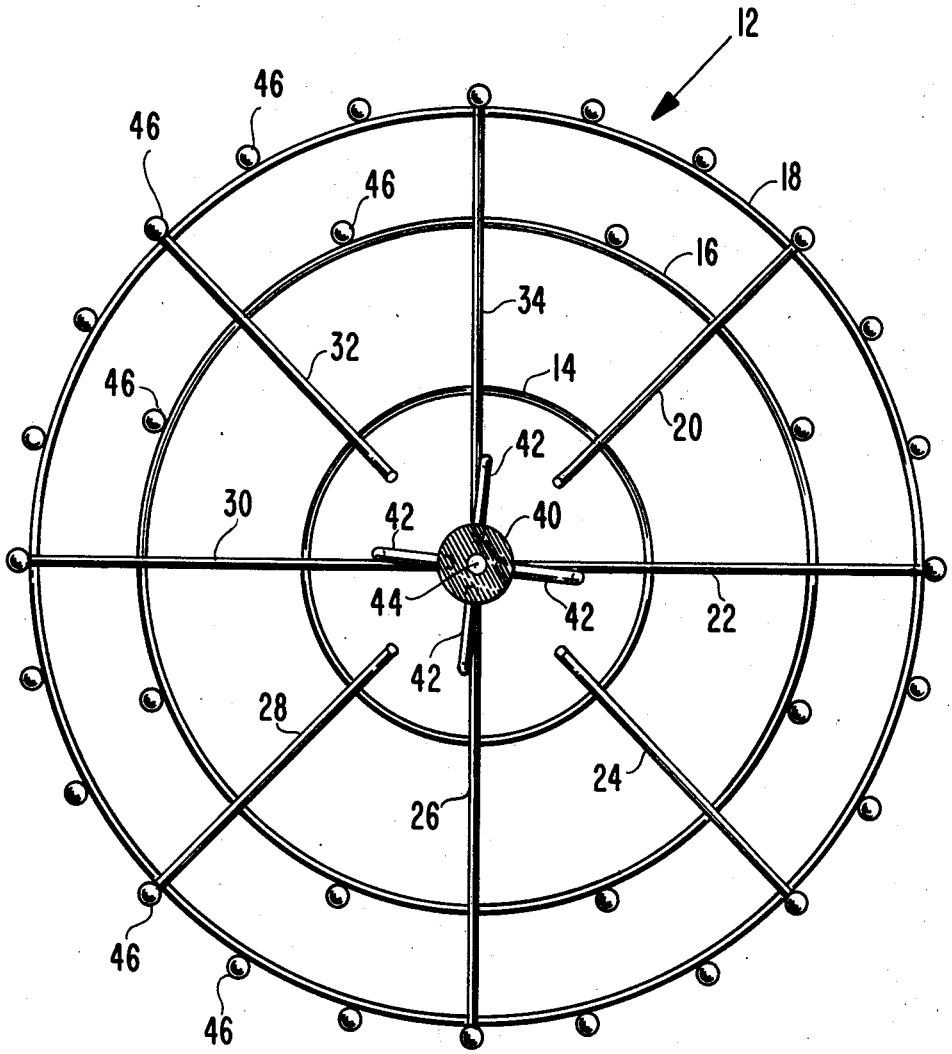
FIG. 2 is a top view of the rotatable frame of the plant-mobile.

Referring now to FIG. 1, a perspective view of a wall-mounted plant-mobile 10 is shown. The plant-mobile 10 comprises a rotatable frame 12, a top view of which is shown in FIG. 2. The rotatable frame 12 comprises a series of coaxial annular members 14, 16, 18 which are attached to one another by radial members 20, 22, 24, 26, 30, 32, 34. Some of the radial members 22, 26, 30, 34 extend to a central support portion 36. The central support portion 36 of the preferred embodiment of the plant-mobile 10 comprises a pair of metal washers 38, 40. In the embodiment 10, shown in FIG. 1, the first washer 38 is attached to radial members 22, 26, 30, 34. The second washer 40 has its central hole aligned with the central hole of the first washer 38. The second washer 40 is supported by offset members 42 which are in turn supported by radial members 22, 26, 30, 34.

In the preferred embodiment of the invention, the various elements of the rotatable frame 12 described above are made of iron, and the elements are welded together. Accordingly, the sides of the offset members 42 are welded to the sides of the radial members 22, 26, 30, 34 as shown in FIGS. 1 and 2. Also, the washers 38, 40 are welded to the radial members 22, 26, 30, 34 and to the offset members 42 so that the central hole 44 of the second washer 40 is aligned with an identical hole in the first washer 38.

The rotatable frame 12 further comprises a series of plant supports 46 which are spaced uniformly around the outer annular member 18 and around the adjacent annular member 16. In the preferred embodiment of the invention 10, the plant supports 46 are comprised of iron balls welded to the annular members. It should be obvious, though, that the number and location of the plant supports 46 and their precise shape may vary without departing from the invention. Thus, the plant supports may be comprised of hooks rather than the balls 46 of the preferred embodiment 10.

With reference to FIG. 1, a series of potted plants 48 is shown. Each plant is in a pot 50 which is suspended from one of the plant supports 46 by a length of nylon monofilament 52 in the preferred embodiment of the invention 10. The use of nylon monofilament 52 enhances the floating effect which the plants are given by the plant-mobile 10, however other hanging means, such as macrame plant hangers, may be used.

Some plants which are used for decorative purposes, such as Spider plants, have shoots 54 sometimes called "babies" or "Spider babies" which extend away from the plant. The "Spider babies" 54 may be hung over the radial members or over the annular members for support and decoration. Climbing plants or vines may also be hung from the plant-mobile 10 and they may also use the radial members and annular members for support.

Figure 3:
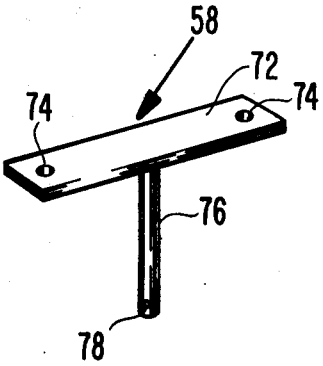
FIG. 3 is a perspective view of a ceiling mount for the plant-mobile.
Figure 4:
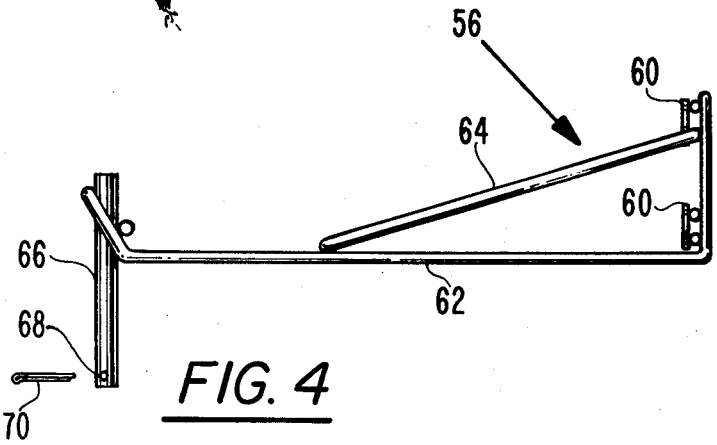
FIG. 4 is a side view of a wall mount for the plant-mobile of the type shown in FIG. 1.

In use, the rotatable frame 12 is supported from a mounting means, such as the wall bracket 56, as shown in FIGS. 1 and 4, or the ceiling bracket 58, as shown in FIG. 3. The wall bracket 56 comprises a support structure having means, such as iron washers 60, which are used in the preferred embodiment of the invention 10, through which bolts, screws, or nails may be inserted to hold the bracket 56 to a wall. The bracket 56 further comprises a pair of horizontal support arms 62 which are longer than the radius of the rotatable frame 12 and which are braced by diagonal arms 64. The bracket 56 further comprises a shaft 66 which preferably extends down vertically from the horizontal support arms 62. At the lower end of the shaft 66 there is a hole 68 through which a cotter pin 70 may be inserted after the washers 38, 40 of the rotatable frame 12 are inserted over the shaft 66. When the plant-mobile is thus assembled with the bracket 56 mounted on a wall, the rotatable frame 12 may be rotated as desired for adding, removing, or watering plants, or to allow different plants to receive light from different angles.

Similarly, a ceiling bracket 58, shown in FIG. 3, comprises a horizontal plate 72 having a pair of holes 74 therein through which screws, bolts, or nails may be inserted to secure the ceiling bracket 58 to a ceiling or other horizontal surface. A shaft 76 having a hole 78 bored therethrough is securely attached to the horizontal plate 72 and is used in the same manner as the shaft 66 and holes 68 of the wall bracket 56 which has already been described.

While the preferred embodiment of the plant-mobile 10 has been described, a number of obvious changes can be made in the plant-mobile without departing from the spirit or scope of the invention. In particular, the inventor contemplates that a method of rotatably mounting the rotatable frame 12 to either a wall bracket 56 or a ceiling bracket 58 without the use of a cotter pin can be employed. For example, the ends of the shaft 66 can be threaded and a threaded cap or a threaded nut 178 of the type shown in FIG. 5 used to hold a ceiling light fixture in place could be used. Also, while the preferred embodiment of the plant-mobile 10 was made using welded iron, other materials, such as other metals or plastics could be used.

The inventor also contemplates the inclusion of a motorized mount capable of slowly rotating the rotatable frame 12 in order to provide the various plants with uniform lighting conditions or for decorative purposes. Such embodiment would be made by mounting a motor, such as the electric motor 180 shown in FIG. 5, having a shaft in place of the shafts 66, 76, described herein and then mounting the rotatable frame 12 from the motor's shaft. In such an embodiment, the rotatable frame 12 would be secured to the motor's shaft, as by a set screw, in order to have the frame 12 rotate when the motor's shaft rotates.

Figure 5:
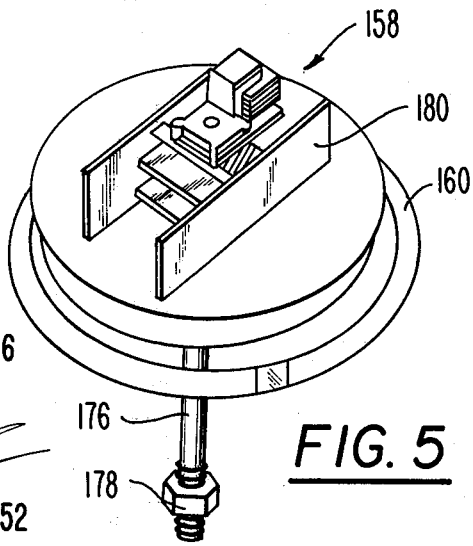
FIG. 5 is a view of an alternative ceiling mount which includes an electric motor, a light, and a threaded shaft.

The inventor also conceives of the inclusion of lighting means, either incandescent or fluorescent, as part of the mounting bracket holding the rotatable frame 12. For example, a ceiling bracket 158 could be modified to include an annular "halo" fluorescent light 160 as shown in FIG. 5 with the shaft 176 extending through the light fixture so that the rotatable frame is hung below the fluorescent bulb and the plants receive light therefrom. It should also be recognized that the radius of the rotatable frame may be altered as can the number of radial members or annular members without departing from the spirit or scope of the invention.

I claim:

1. A plant-mobile comprising:

(a) a mounting means adapted to hang from a wall or ceiling, said mounting means including a shaft; and (b) a rotatable frame having at least one annular member including thereon plant support means for supporting potted plants, said annular member being attached to a central support member by a plurality of radial members, said central support member including means for rotably mounting said rotatable frame on said shaft of said mounting means, said rotatable frame being adapted to rotate in a substantially, horizontal plane, said plant support means comprising a plurality of string-like elements each of which is attached to said rotatable frame and each of which is adapted to support a potted plant hanging therefrom.

2. The plant-mobile of claim 1 wherein said mounting means is a wall bracket which is adapted to be secured to a wall or other vertical surface and which has at least one horizontal support arm at one end of which said shaft is attached, the other end of which is affixed to said vertical surface, said horizontal support arm being longer than said radial members of said rotatable frame.

3. The plant-mobile of claim 1 wherein said mounting means is a ceiling bracket which is adapted to be secured to a ceiling or other horizontal surface, said shaft being substantially vertical and extending down from said ceiling bracket.

4. The plant-mobile of claim 1 wherein said means for rotatably mounting said rotatable frame comprises a pair of washers having aligned holes through which the shaft of the mounting means is fitted.

5. The plant-mobile of claim 4 wherein the end of said shaft has a hole bored therethrough and said means for rotatably mounting said rotatable frame comprises a cotter pin which is placed through said hole.

6. The plant-mobile of claim 4 wherein the end of said shaft is threaded and said rotatable frame is rotatably mounted thereon by a nut.

7. The plant-mobile of claim 1 further comprising means for illuminating said plants, said means for illuminating being incorporated into said mounting means.

8. The plant-mobile of claim 7 wherein said means for illuminating comprises a halo type fluorescent bulb and fixture adapted to hange from a ceiling and said shaft extends down from the center of the circle formed by said bulb.

9. The plant-mobile of claim 8 wherein said shaft extends down from an electric motor mounted on said fixture, the shaft of said motor being firmly attached to said rotatable frame, said motor being adapted to rotate said frame while said light is on.

10. The plant-mobile of claim 1 wherein said mounting means includes an electric motor which turns said shaft and said rotatable from is firmly attached to said shaft.

* * * * *